United States Patent [19]

Sudbury et al.

[11] 4,439,304

[45] Mar. 27, 1984

[54] PROCESS FOR BENEFICIATING HIGH SULFUR, HIGH FLUIDITY COAL

[75] Inventors: John D. Sudbury; Clyde W. Zielke, both of McMurray, Pa.

[73] Assignee: Conoco Inc., Wilmington, Del.

[21] Appl. No.: 396,978

[22] Filed: Jul. 9, 1982

[51] Int. Cl.[3] ..... C10G 1/00; C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,018,241 | 1/1962 | Gorin . | |
| 3,018,242 | 1/1962 | Gorin . | |
| 4,011,153 | 3/1977 | Fu | 208/10 |
| 4,119,523 | 10/1978 | Baldwin . | |
| 4,159,236 | 6/1979 | Schmid . | |
| 4,247,384 | 1/1981 | Chen et al. | 208/8 LE |
| 4,248,605 | 2/1981 | Lancet | 208/8 LE X |
| 4,353,713 | 10/1982 | Cheng | 201/2.5 X |
| 4,376,032 | 3/1983 | Givens | 208/8 LE |

FOREIGN PATENT DOCUMENTS

| | | | |
|---|---|---|---|
| 2802825 | 7/1978 | Fed. Rep. of Germany | 208/10 |

*Primary Examiner*—William G. Wright

*Attorney, Agent, or Firm*—Dale Lovercheck; William A. Mikesell, Jr.

[57] ABSTRACT

A method of forming a liquefied coal product having a lower sulfur percent by weight than the solid coal from which it is derived comprising the steps as follows:

(a) providing solid coal having a sulfur percent by weight of a particle size less than about 14 Tyler mesh, (b) providing calcium oxide of a particle size less than about 40 Tyler mesh, (c) mixing said solid coal and said calcium oxide with liquefaction solvent to form a liquefaction mixture, (d) hydrogenating and heating said liquefaction mixture to at least about 750° F. forming a liquefied coal product having residual coal solids and calcium sulfide solids, said liquefied coal product having a liquefied coal product sulfur percent by weight, which is less than said solid coal sulfur percent by weight.

17 Claims, 1 Drawing Figure

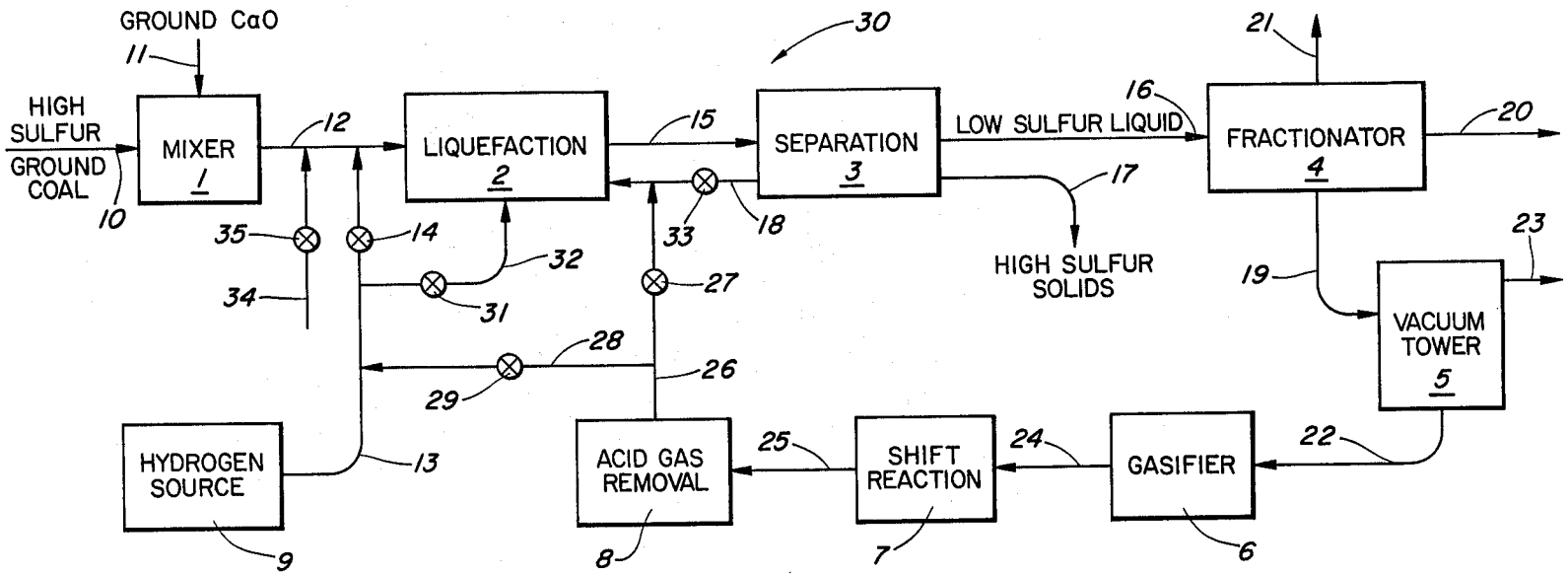
HIGH SULFUR GROUND COAL
GROUND CaO
MIXER 1
LIQUEFACTION 2
SEPARATION 3
FRACTIONATOR 4
VACUUM TOWER 5
GASIFIER
SHIFT REACTION
ACID GAS REMOVAL
HYDROGEN SOURCE
LOW SULFUR LIQUID
HIGH SULFUR SOLIDS
10
11
12
13
14
15
16
17
18
19
20
21
22
23
24
25
26
27
28
29
30
31
32
33
34
35
6
7
8
9

PROCESS FOR BENEFICIATING HIGH SULFUR, HIGH FLUIDITY COAL

BACKGROUND OF THE INVENTION

Gorin U.S. Pat. No. 3,018,241 discloses production of hydrogen rich liquid fuels from coal.

Gorin U.S. Pat. No. 3,018,242 discloses production of hydrogen enriched hydrocarbonaceous liquids using an extraction zone.

Baldwin et al U.S. Pat. No. 4,119,523 discloses a process for the production deashed coal using solvents including fused ring aromatic hydrocarbons containing two, three or four fused rings such as tetralin, decalin, diphenyl. Typically coal derived dissolving solvents contain these compounds as well as many isometric compounds, similar polycyclic compounds and various alkylated derivatives. In addition, such solvents contain various heterocyclic oxygen, nitrogen, and sulfur compounds. Other common components are a range of phenolic compounds. Such solvents can also be catalytically hydrogenated to increase their contents of useful hydroaromatic components (i.e. the so-called hydrogen donor componds). Column 7 lines 33–48.

Schmid U.S. Pat. No. 4,159,236 discloses a process of coal liquefaction and gasification. He notes that it has been observed that iron in coal functions as a hydrocracking catalyst at Column 13 lines 45–49. Preheated slurry of coal and solvent passes through a dissolver at 840 to 870° F. which corresponds to 449° to 466° C. The dissolver effluent passes to a vapor liquid separator system. The liquid distillate is passed to a fractionator. The non-condensed gas which comprises hydrogen sulfide is passed to an acid gas removal unit. As noted in colum 17 lines 26–50 the bottoms of the vacuum tower comprising all of the normally solid dissolved coal, undissolved organic matter and mineral matter, without any distillate liquid or hydrocarbon gas is passed to partial oxidation gasifier. Note column 18 lines 23–27.

Fu U.S. Pat. No. 4,011,153 discloses a process for desulfurizing and liquefying by heating said coal at 375–475° C. in the presence of a slurry liquid, hydrogen, carbon monoxide, steam and a catalyst comprising a desulfurization catalyst and an alkali metal salt. Likewise catalytic liquefaction is disclosed in Karr U.S. Pat. No. 4,018,663, and Pitchford U.S. Pat. Nos. 3,728,252 and 3,930,984.

Lancet U.S. Pat. No. 4,248,605 discloses gasification of coal liquefaction residues by mixing the bottoms fraction with at least one finely divided calcium compound including calcium oxide of a size no larger than about −200 Tyler mesh.

SUMMARY OF THE INVENTION

A method of forming a liquefied coal product having a lower sulfur percent by weight than the solid coal feed from which it is derived comprising the steps as follows:

(a) providing solid coal feed having a substantial sulfur content by weight percent and of a particle size sufficiently small for a substantial portion of said sulfur to readily react with a calcium compound, (b) providing said calcium oxide of a particle size sufficiently small to readily react with said sulfur, (c) mixing said solid coal and said calcium oxide with liquefaction solvent to form a liquefaction mixture, (d) hydrogenating and heating said liquefaction mixture to at least about 750° F. forming a liquefied coal product having residual coal solids and calcium sulfide solids, whereby the percent by weight of sulfur in said liquefied coal product is substantially less in said liquefied coal product than in said solid coal feed.

Generally the suflur content of coal is considered high if it is 2% by weight or greater.

BRIEF DESCRIPTION OF THE DRAWING

The drawing is a schematic representation of a process in accordance with the present invention.

DETAILED DESCRIPTION OF THE INVENTION

The invention relates to an improved process for the production of coal liquefaction liquids of reduced sulfur content from high sulfur coal feeds. High sulfur coal feeds have sulfur contents from 2 percent to 6 percent and higher sulfur by weight. Ground coal, for example 14 Tyler mesh or smaller ground coal particles are slurried with coal liquefaction solvent and fine particles of calcium oxide to a coal liquefaction unit. The calcium oxide particles for use in the present invention are preferably less than 80 Tyler mesh and most preferably less than 100 Tyler mesh. The liquefaction reaction is operated at least at or above 750° F. and generally between 800 and 950° F. and is fed molecular hydrogen.

The sulfur (coal-S or coal liquid-S) and CaO may react according to the reactions:

$$H_2+S \rightarrow H_2S \quad \text{(I)}$$

and $$H_2S+CaO \rightarrow CaS+H_2O \quad \text{(II)}$$

the overall reaction being $$H_2+S+CaO \rightarrow CaS+H_2O \quad \text{(III)}$$

For example at 900° F., sulfur in the liquefied coal reacts with the calcium oxide to form calcium sulfide. The calcium sulfide is readily removed for example by filtration. Thus, a liquefied coal product is formed having a sulfur content which is less than the sulfur content of the sulfur containing coal from which it is derived. This liquefied coal product may contain some residual solids which may be removed by processes known in the art for this purpose. See for example Gorin et al U.S. Pat. No. 3,791,956 and Gorin U.S. Pat. No. 4,075,080.

In the liquefaction unit coal having a high sulfur content is dissolved by the coal liquefaction solvent. Suitable coal liquefaction solvents are known in the art and are discussed in Baldwin et al U.S. Pat. No. 4,119,523 at column 7, lines 25–48. Preferred solvents include fused ring aromatic hydroaromatic and alicyclic hydrocarbons containing 2, 3 and 4 fused benzene or saturated rings such a tetralin, decalin, diphenyl, methyl naphthalene, diphenyl naphthalene, fluorene, anthracene, phenanthrene, pyrene and chrysene. In addition, such solvents generally contain various heterocyclic oxygen, nitrogen, and sulfur compounds.

The sulfur in the high sulfur coal particles in the liquefaction unit may start in the form of inorganic sulfur compounds for example $FeS_2$ or as organic sulfur. During the liquefaction process the sulfur in the coal forms hydrogen sulfide under the hydrogenating conditions. This hydrogen sulfide reacts with the calcium oxide to form calcium sulfide. By providing calcium oxide for the formation of calcium sulfide, the partial pressure of hydrogen sulfide is reduced thus allowing the equilibrium of the reaction of sulfur with hydrogen to proceed more fully towards the hydrogen sulfide side. By so doing the FeS formed as well as organic sulfur compounds which are normally difficult to reduce is reduced leaving iron or sulfur-"free" organics and additional calcium sulfide. The amount of calcium oxide necessary to enchance desulfurization of the high sulfur coal feed is dependent on the amount of sulfur in the coal feed. Generally a molar ratio of 1:1 for the sulfur in the coal feed and the calcium oxide added is sufficient. However, molar amounts of calcium oxide or higher are certainly within the scope of the invention as well as lower amounts of calcium oxide with the expected increase or decrease respectively in the amount of sulfur removed.

The liquefaction unit 2 may comprise a slurry mixing tank in which ground coal and ground calcium oxide are mixed into liquefaction solvent. The liquefaction unit 2 may further comprise a slurry preheater through which the slurry to be mixed in the mixing tank is fed on its way to a dissolver. The dissolver is operated preferably between 800 and 900° F. The separation unit 3 may comprise a vapor liquid separator which is fed a slurry from the dissolver. Vapor from the vapor liquid separator preferably passes to an acid gas removal unit. A portion of the liquid from the separation unit passes to a fractionator. The fractionator 4 provides liquid products through line 20 including naphtha and fuel oil.

With more particular reference to the drawing, it is seen that a process for beneficiating high sulfur high fluidity coal is shown generally at 30. High sulfur ground coal is fed through line 10 to the mixer 1. Ground calcium oxide is fed through line 11 to the mixer 1. Mixer 1 mixes the coal and calcium oxide. The mixture of coal and calcium oxide is fed through line 12 to the liquefaction unit 2. In the liquefaction unit 2 the mixture of ground coal and calcium oxide is liquefied under hydrogenating conditions whereby hydrogen sulfide is formed in accordance with reaction (I) above. The hydrogen sulfide thus formed then reacts with the ground calcium oxide to form calcium sulfide in accordance with reaction (II) above.

The products of liquefaction pass through line 15 into separation unit 3. The high sulfur solids pass from the separation unit 3 through line 17. The high sulfur solids include the calcium sulfide. The low sulfur liquid passes from the separation unit 3 through line 16 to the fractionator 4. Liquid product leaves the fractionator 4 through line 20. Gaseous product leaves the fractionator 4 through line 21. The gaseous product from the fractionator includes methane which may be used as a fuel gas. The liquid product in line 20 from the fractionator 4 includes fuels suitable for use in internal combustion engines. The bottoms from the fractionator 4 pass through line 19 to the vacuum tower 5. Liquid products from the vacuum tower 5 pass through line 23. The bottoms from the vacuum tower 5 pass through line 22 to the gasifier 6. The gas leaving the gasifier 6 passes through line 24 to shift reaction unit 7. In the shift reaction unit 7, carbon monoxide reacts with water to form carbon dioxide and hydrogen. The gas from the shift reaction unit 7 passes through line 25 to the acid gas removal unit 8. In the acid gas removal unit 8, carbon dioxide and any hydrogen sulfide that had not reacted with CaO may be removed from the hydrogen-rich gaseous mixture leaving through line 26.

Liquid from the separation unit 3 may be recycled through line 18 to the liquefaction unit 2. To do this the valve 33 is opened. To hydrogenate this recycle liquid in line 18, the valve 27 is opened allowing hydrogen-rich gas to pass from line 26 into line 18 for hydrogenation of the recycle liquid passing from separator 3 to liquefaction unit 2.

Hydrogen-rich gas passes from the acid gas removal unit 8 through line 26 with valve 27 open into line 18 for hydrogenation or recycle liquid in line 18.

Makeup liquid for liquefaction may be passed through lie 34 into line 12 to slurry the mixture of ground coal and calcium oxide into the liquefaction unit 2. For addition of liquefaction solvent the valve 35 in line 34 is opened. Makeup hydrogen passes from hydrogen source 9 through line 13. By opening the valve 14 makeup hydrogen passes from line 13 into line 12 for hydrogenation of makeup liquefaction solvent therein. By opening valve 31 in line 32, hydrogen passes from hydrogen source 9 through line 13 and line 32 into the liquefaction unit 2.. Hydrogen-rich gas from the acid gas removal unit 8 passes through line 26 and through line 28 with valve 29 open into line 13. The hydrogen-rich gas continues from line 13 through line 32 into the liquefaction unit 2 when the valve 31 is opened.

On an overall basis, the high sulfur ground coal is converted to low sulfur liquid products which leave through lines 20 and 23. The ground calcium oxide being fed through line 11 contributes to the formation of the high sulfur solids leaving through line 17 from separation unit 3.

Having thus described the invention by reference to certain of its preferred embodiments it is respectfully pointed out that embodiments described are illustrative rather than limiting in nature and that many variations and modifications are possible within the scope of the present invention. Such variations and modifications may appear obvious and desirable to those skilled in the art upon a review of the foregoing description of preferred embodiments.

What is claimed is:

1. A method of forming a liquefied coal product having a lower sulfur percent by weight than the high sulfur solid coal feed from which it is derived consisting essentially of the sequence of steps as follows:

(a) providing solid coal having at least two percent by weight sulfur and a particle size less than about 14 Tyler mesh, (b) providing calcium oxide of a particle size less than about 40 Tyler mesh, (c) mixing said solid coal and said calcium oxide with liquefaction solvent to form a liquefaction mixture, (d) hydrogenating and heating said liquefaction mixture to at least about 750° F. forming a mixture of low sulfur liquefied coal liquid, residual coal solids and calcium sulfide solids.

said liquefied coal having a liquefied coal sulfur percent by weight which is substantially less than said two percent by weight sulfur of said solid coal, whereby a substantial proportion of said sulfur of said coal reacts with said calcium oxide to form said calcium sulfide, (e) filtering said liquefied coal from said residual solids and said calcium sulfide solids to separate a low sulfur liquefied coal liquid product.

2. The method of claim 1 wherein said hydrogenation is provided by a hydrogenated coal liquefaction solvent.

3. The method of claim 1 wherein said hydrogenation is provided by contacting said feed slurry with molecular hydrgen.

4. The method of claim 1 wherein said calcium oxide particle size is less than about 80 Tyler mesh.

5. The method of claim 3 wherein said hydrogenation is provided by hydrogenated coal liquefaction solvent.

6. The method of claim 5 wherein said hydrogenation is provided by a hydrogenated coal liquefaction solvent.

7. The method of claim 5 wherein said hydrogenation is provided by contacting said feed slurry with molecular hydrogen.

8. The method of claim 5 wherein said calcium compound particle size is less than about 100 Tyler mesh.

9. The method of claim 5 wherein the weight percent sulfur in said solid coal feed is two percent or greater.

10. The method of claim 1 further comprising (e) Separating said liquid liquefied coal product from a high-sulfur said residual coal solids and said calcium sulfide solids, (f) fractionating said liquid liquefied coal product to form a low surfur liquid product and a low sulfur bottom fraction, said low sulfur liquid product comprising naphtha and fuel oil and having substantially less than two weight percent sulfur, (g) gasifying said low sulfur bottom fraction in a gasification means to form a hydrogen-rich gas product.

11. The method of claim 1 wherein said calcium oxide particle size is less than 100 Tyler mesh.

12. The method of claim 1 wherein said solid coal is high fluidity coal.

13. A method of forming a liquefied coal product having a lower sulfur percent by weight than the solid coal feed from which it is derived consisting essentially of the sequence of steps as follows:

(a) providing solid coal feed having a substantial sulfur percent by weight of a particle size sufficiently small for a substantial portion of said sulfur to readily react with a calcium compound, (b) providing said calcium oxide of a particle size less than about 80 Tyler mesh, (c) mixing said solid coal and said calcium oxide with liquefaction solvent to form a liquefaction mixture, (d) hydrogenating and heating said liquefaction mixture to at least about 750° F. forming a mixture of low sulfur liquefied coal liquid, residual coal solids and calcium sulfide solids, whereby a substantial proportion of said sulfur of said coal reacts with said calcium oxide to form said calcium sulfide, (e) filtering said liquefied coal from said calcium sulfide solids to separate a low sulfur liquefied coal liquid product, whereby the percent by weight of inorganic sulfur in said liquefied coal product is substantially less than the weight percent inorganic sulfur in said solid coal feed.

14. The method of claim 13 further comprising (f) fractionating said liquid liquefied coal product to form a low sulfur liquid product and a low sulfur bottom fraction, said low sulfur liquid product comprising naphtha and fuel oil and having substantially less than two weight percent sulfur, (g) gasifying said low sulfur bottom fraction in a gasification means to form a hydrogen-rich gas product.

15. The method of claim 13 wherein said solid coal is high fluidity coal.

16. A method of sulfur removal to form liquid and gaseous products having a lower sulfur percent by weight than the high sulfur high fluidity solid coal feed from which it is derived consisting essentially of the sequence of steps as follows:

(a) providing solid high fluidity coal having at least two percent by weight sulfur and particle size less than about 14 Tyler mesh, (b) providing calcium oxide of a particle size less than about 80 Tyler mesh, (c) mixing said solid coal and said calcium oxide with liquefaction solvent to form a liquefaction mixture, (d) hydrogenating and heating said liquefaction mixture to at least about 750° F. forming a mixture of low sulfur liquefied coal liquid, residual coal solids and calcium sulfide solids, whereby a substantial proportion of said sulfur of said coal reacts with said calcium oxide to form said calcium sulfide, said liquefied coal having a liquefied coal sulfur percent by weight which is substantially less than said two percent by weight sulfur of said solid coal, (e) filtering said liquefied coal from said residual solids and said calcium sulfide solids, to separate a low sulfur liquefied coal liquid, (f) fractioning said low sulfur liquefied coal liquid to form a gaseous fractionation product, low sulfur fractionated liquid product and low sulfur bottoms, (g) distilling said low sulfur bottoms in a vaccum tower means to form low sulfur vacuum tower bottoms and low sulfur distilled liquid product, (h) gasifying said low sulfur vacuum tower bottoms in a gasification means to form a low sulfur gaseous gasification product.

17. The method of claim 16 wherein said calcium oxide particle size is less than about 100 Tyler mesh.

* * * * *